United States Patent [19]

Perkins

[11] Patent Number: 4,540,343

[45] Date of Patent: Sep. 10, 1985

[54] SPHERICAL GEAR PUMP

[75] Inventor: Gerard T. Perkins, Livonia, Mich.

[73] Assignee: International Hydraulic Systems, Inc., Southgate, Mich.

[21] Appl. No.: 442,253

[22] Filed: Nov. 17, 1982

[51] Int. Cl.[3] ..... F04B 19/02; F04B 49/08; F04C 21/00

[52] U.S. Cl. ..... 417/218; 417/462; 417/481; 91/197; 92/120

[58] Field of Search ..... 417/204, 218, 273, 460, 417/462, 481, 521; 418/16, 19, 24–27, 30, 68, 193, 195, 229–231; 91/197; 92/120; 123/43 R

[56] References Cited

U.S. PATENT DOCUMENTS

| | | | |
|---|---|---|---|
| 739,207 | 9/1903 | Nielsen . | |
| 2,087,772 | 2/1937 | Kempthorne | 418/26 |
| 2,211,417 | 8/1940 | Granberg . | |
| 2,691,348 | 10/1954 | Gunther | 417/462 |
| 3,092,035 | 6/1963 | Freeman | 91/197 |

FOREIGN PATENT DOCUMENTS

| | | | |
|---|---|---|---|
| 700584 | 4/1941 | Fed. Rep. of Germany . | |
| 1176487 | 8/1964 | Fed. Rep. of Germany . | |
| 838270 | 12/1938 | France . | |
| 913907 | 9/1946 | France . | |
| 981234 | 1/1951 | France | 418/26 |
| 1047606 | 12/1953 | France . | |
| 449428 | 4/1968 | Switzerland . | |
| 703808 | 2/1954 | United Kingdom . | |
| 1308295 | 2/1973 | United Kingdom . | |

*Primary Examiner*—John J. Vrablik

*Attorney, Agent, or Firm*—Kenyon & Kenyon

[57] ABSTRACT

A spherical gear pump comprises a housing with a first longitudinal axis, a spherical seat, an inlet and outlet adjacent the seat, inlet and outlet passages communicating with the inlet and outlet and adapted for connection to a source of liquid and a liquid load. A hemispherical gear is rotatively mounted within the seat and includes a plurality of peripherally spaced radial gear teeth and a drive shaft for rotation about the first axis. A hemispherical cam is adjustably positioned within the spherical seat having an arc less than 180°, and radial cam surfaces facing the spherical gear. A plurality of separate symmetrical radial gear teeth are pivotally mounted within and between the teeth of the spherical gear with each separate gear tooth having a radial top wall centrifugally biased against the cam surfaces on rotation of the spherical gear and a bottom wall adapted for pivotal movements within planes passing through the first axis on rotation of the separate gear teeth over the cam surfaces.

53 Claims, 16 Drawing Figures

FIG. 1
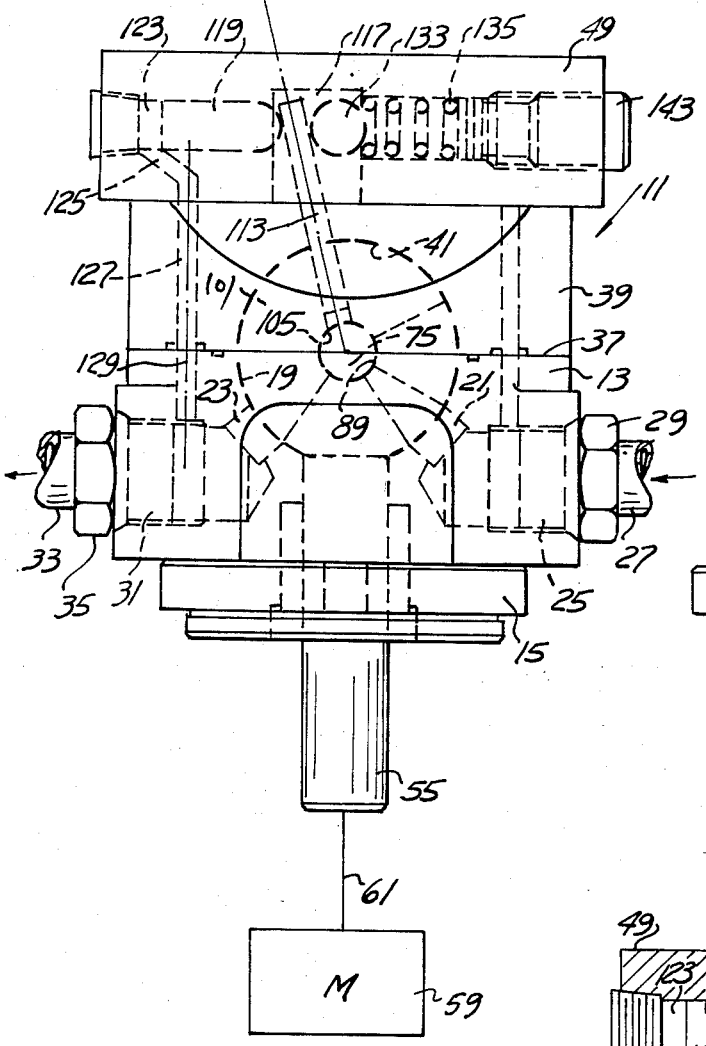
FIG. 2
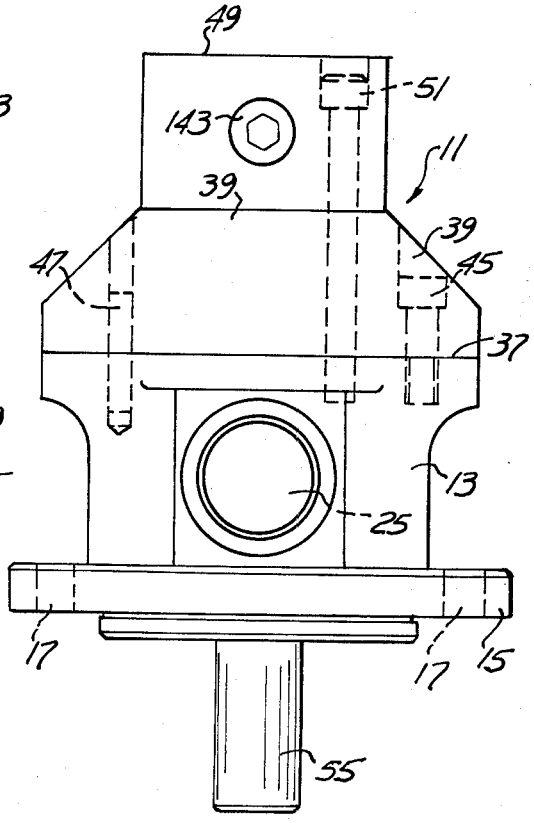
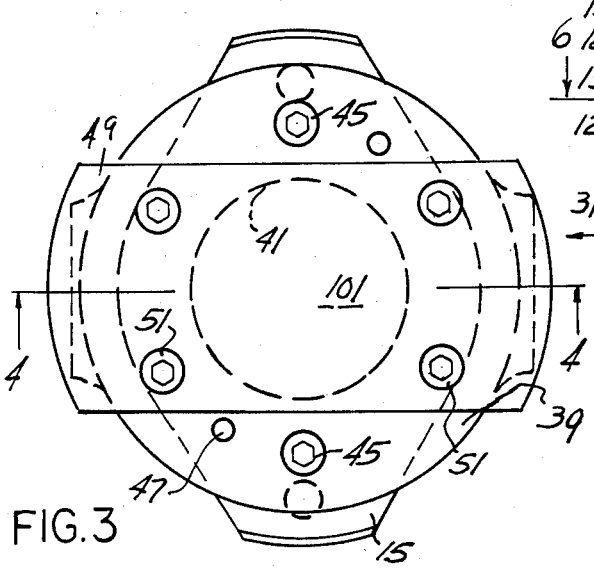
FIG. 3
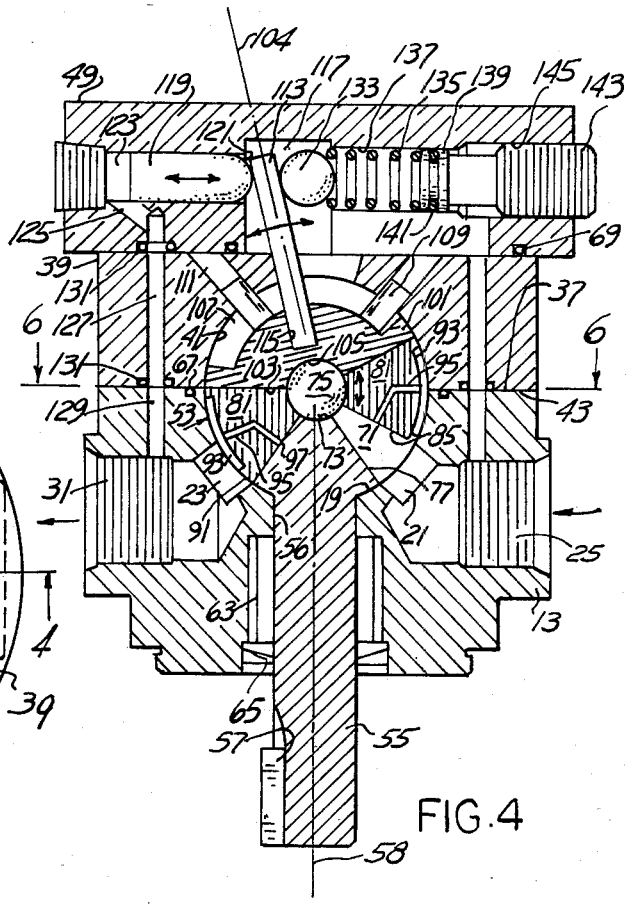
FIG. 4

FIG. 5
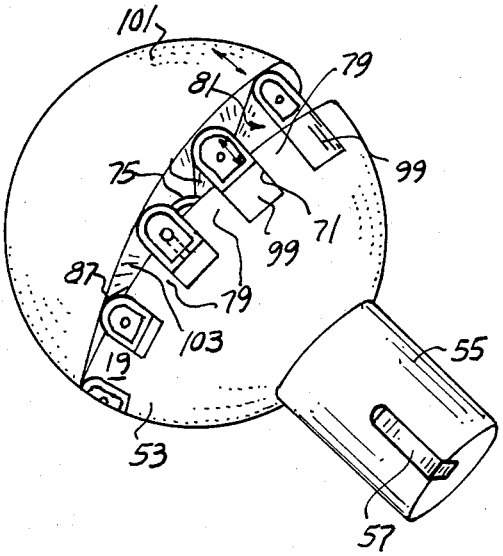
FIG. 6
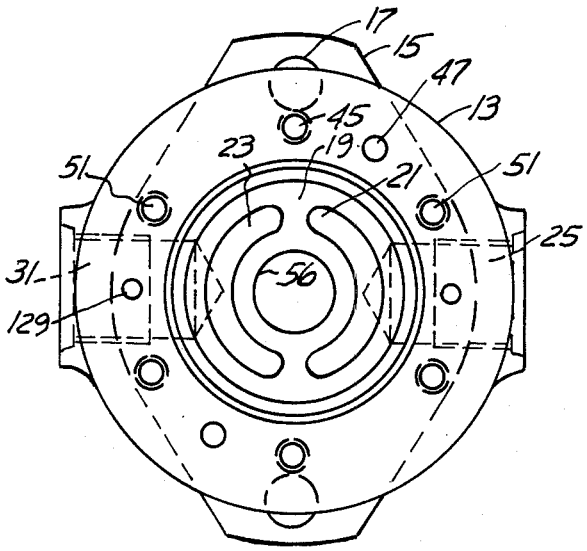
FIG. 7
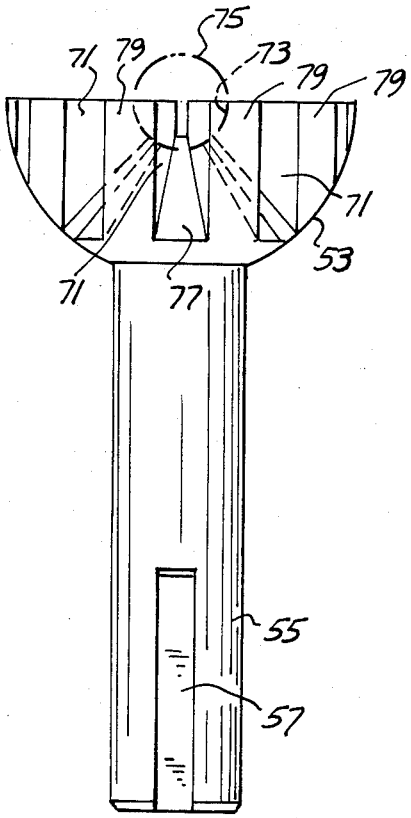
FIG. 8
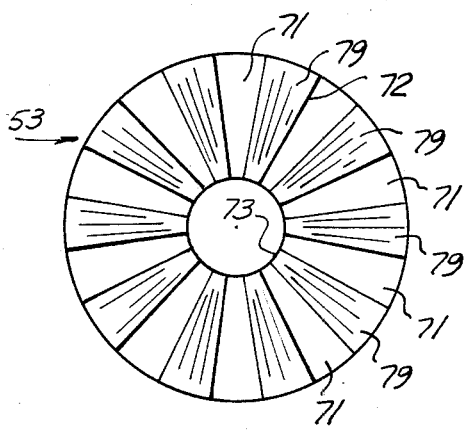
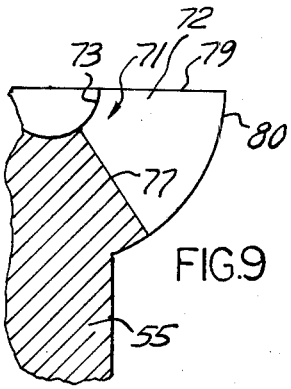
FIG. 9

FIG. 10
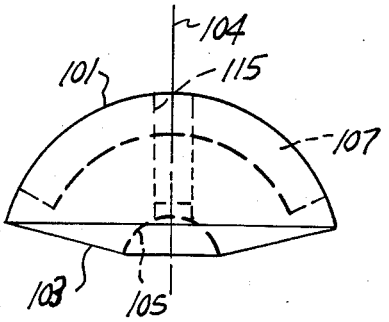
FIG. 11
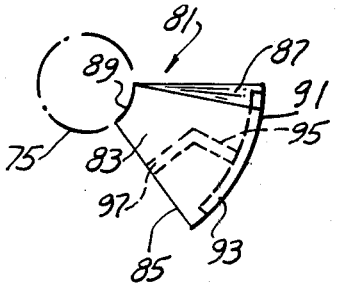
FIG. 12
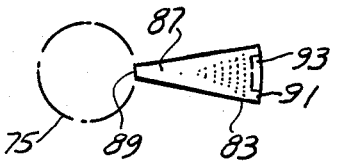
FIG. 13
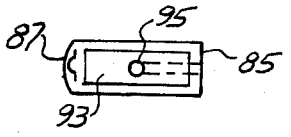
FIG. 14
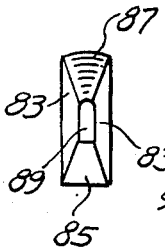
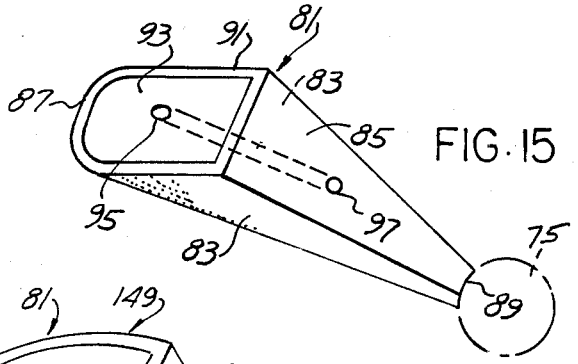
FIG. 15
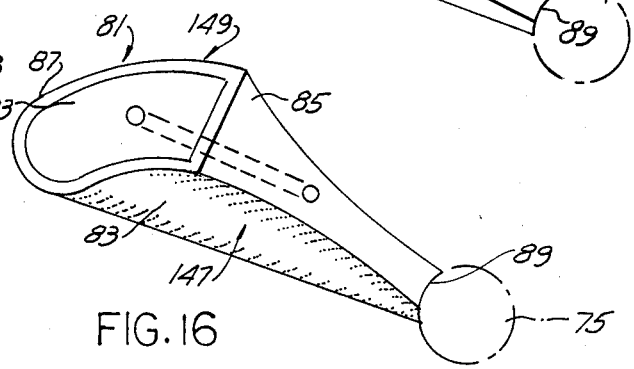
FIG. 16

SPHERICAL GEAR PUMP

BACKGROUND OF THE INVENTION

Heretofore in the art of pumping fluids and particularly liquids there have been employed gear pumps and fixed and variable volume vane pumps and piston pumps. One of the difficulties with prior art gear pumps is that they pump only a constant volume. Other problems include loss of efficiency due to wear. Normally variable volume vane pumps are inefficient. Piston pumps are the only practical pump designed to provide variable volume at high efficiency. These are the most costly due to close tolerance machining required. They are intollerant to fluid contamination.

Vane pumps may be provided for a variable volume delivery, however, they are inefficient due to the internal mechanism required for regulating eccentricity. They are inefficient because of the increased clearances required.

Heretofore in vane type pumps, the vanes as they laterally push fluids responding to an eccentric curvature of the casing experience considerable transverse stress upon the sides of the respective vanes which tend to tilt or bend the vanes causing increased friction particularly against radial movements of the vanes in responding to variations of the cavity radius. In the use of vane type pumps, these transverse stresses upon the vanes produce internal stresses which are transferred to the rotor causing early wear and breakdown due often to high unit loading forces transmitted to the rotor and vanes.

SUMMARY OF THE INVENTION

An important feature of the present invention is to provide a fixed and variable volume gear pump and wherein a single spherical gear is employed.

A further feature contemplates in conjunction with a spherical gear rotatable within a spherical cavity in a pump casing and wherein there is provided a spherical cam portending an arc less than 180° and wherein there are provided upon the spherical gear a series of peripherally spaced radially extending gear teeth defining a plurality of axially extending pumping chambers.

As a further feature there is provided a plurality of separate radially extending pivoted gear teeth biased axially outward by centrifugal force during rotation for engagement with opposing cam surfaces for creating a pumping action.

A further feature of the present invention includes a separate and individual radial extending gear teeth which are movably mounted within the individual axially extending pumping chambers which are adapted for pivotal movements within said chanbers and with respect to the spherical gear with the individual gear teeth pivoting in planes which pass through the axis of rotation of the spherical gear.

A further feature is to provide an improved and novel spherical gear pump having an automatic variable volume delivery and wherein a spherical gear rotates on a first axis and a spherical cam has a central axis referred to as a second axis which is inclined at an acute angle to the first axis to thereby achieve on rotation of the spherical gear and the individual separate gear teeth registering with the cam surfaces a pumping action of the separate gear teeth.

A further feature includes the use of centrifugal forces developed during rotation of the spherical gear wherein the separate radially extending gear teeth guidably mounted upon the spherical gear are adapted for pivotal movements in axial planes passing through the axis of the spherical gear as the respective forward edges of the individual radial gear teeth respond to variations in the cam surfaces of the spherical cam.

A further feature provides pivotal movement of the separate radial gears within the spherical gear creating a pumping action within each of the plurality of axially extending pumping chambers within the spherical gear.

The present spherical gear pump overcomes the objections heretofore encountered with vane type pumps namely, the transverse stresses applied to the vanes. In the present pump there are no transverse stresses applied to the individual gear teeth. Due to the pivotal pumping action of the separate gear teeth there is prevented any transverse shear as is encountered with vane type pumps wherein there is high unit loading of the vanes. During the pumping action loading forces are transmitted over the entire surface of the spherical cavity.

A further feature provides within a spherical cavity of the pump housing a hemispherical gear having a series of radially extending gear teeth defining individual pumping chambers therebetween and wherein a plurality of spaced radially extending separate gear teeth are pivotally and movably positioned within the pumping chambers during rotation of the spherical gear. Said teeth respond to variations in the cam surfaces of a hemispherical cam for achieving a pumping action drawing liquid from an inlet in the pump casing adjacent the cavity and delivering pressurized liquid through an outlet in the casing in a continuous pumping action.

A further feature contemplates that during the pumping action there is a normal acute angular relationship between the axis of rotation of the spherical gear and the central axis of the cam wherein the angularity between said axes is automatically regulated for modifying the volume of the pumped liquids and wherein as the angle between the respective axes is reduced, the pumping volume is correspondingly reduced, and where the angularity is reduced to zero, the pumping volume is zero.

A further feature contemplates the automatic adjustment of the hemispherical cam for movement in a unit plane and wherein such angular adjustment reducing the angle between the respective above axes is automatic in response to volume demands from a liquid load. The pump is normally set for a maximum liquid delivery. Upon any reduction in the demand for the volume of liquid some of the pressurized liquid from the exhaust passage is delivered to a compensator assembly upon the pump so that the piston therein is capable of tilting the spherical cam to proportionally reduce the angle between the respective above axes and correspondingly reducing the pumping volume.

A further feature contemplates that should the pumping demand fall off to zero, the full pressure is delivered to the compensating housing with the result that the piston responsive to said pressure mechanically moves the hemispherical cam and cam surfaces to a central neutral position eliminating all pumping volume. It further follows in reverse that as the demand progressively increases for pumped liquids, the pressure upon the piston will be gradually reduced proportionally permitting the spring bias within the compensator housing to move the cam so as to gradually increase the angle between the above respective axes in an automatic manner and increase the volume of liquid pumped.

A further feature contemplates the heat treating of the pump housing and its spherical cavity surface and the spherical gear and grinding thereof to establish effective long lasting bearing surfaces between the pump cavity surface and the spherical gear and the separate gear teeth mounted thereon.

These and other objects and features will be seen from the following specification and claims in conjunction with the appended drawings.

THE DRAWINGS

FIG. 1 is a front elevational view of the present variable volume gear pump.

FIG. 2 is a side elevational view thereof.

FIG. 3 is a plan view thereof.

FIG. 4 is a vertical section of the gear pump taken in the direction of arrows 4—4 of FIG. 3.

FIG. 5 is a schematic perspective view of the spherical gear and spherical cam in a use position as it would be mounted within a spherical seat of the present pump.

FIG. 6 is a plan view of the lower casing of the pump taken in the direction of arrows 6—6 of FIG. 4.

FIG. 7 is a side view of the present spherical gear and drive shaft.

FIG. 8 is a plan view thereof.

FIG. 9 is a fragmentary section on an increased scale of a portion of the radial gear teeth shown in FIG. 7.

FIG. 10 is a plan view of the spherical cam shown in FIG. 4.

FIG. 11 is a side view of one of the separate radial gear teeth shown in FIGS. 4 and 5, with the inner spherically recessed end of the tooth in engaging registry with a ball interposed between the spherical gear and the spherical cam and shown in dash lines.

FIG. 12 is a plan view thereof.

FIG. 13 is an end view of the separate gear tooth shown in FIG. 12.

FIG. 14 is an inner end view of the separate gear tooth.

FIG. 15 is a perspective view of the separate gear tooth.

FIG. 16 is a perspective view of the separate gear tooth shown in FIG. 15, slightly modified wherein the opposing sides are partly curved to define conical segments.

It will be understood that the above drawings illustrate merely a preferred embodiment of the invention, and that other embodiments are contemplated within the scope of the claims hereafter set forth.

DETAILED DESCRIPTION OF AN EMBODIMENT OF THE INVENTION

Referring to the drawings and particularly FIGS. 1 through 5, the present spherical gear pump 11 has a housing which includes lower casing 13, FIGS. 1, 2 and 3 having a mount flange 15 apertured at 17 for securing to a suitable support.

Within the housing, there is provided a spherical seat defined by hemispherical seat 19 within lower casing 13, which as shown in FIG. 6, has an arcuate inlet 21 having an extent less than 180 degrees and opposed and spaced therefrom a similar arcuate outlet 23. The inlet and outlet is formed within the lower casing adjacent the hemispherical seat 19 for communication therewith. Liquid inlet passage 25, FIGS. 1, 4 and 6 at one end is in communication with inlet 21 and at its other end is connected to the conduit 27 from a source of liquid utilizing fitting 29 at the outer end of inlet passage 25.

Outlet passage 31 formed within the lower casing at one end is in communication with arcuate outlet 23 and at its other end through a fitting 35 is connected to the pipe 33 for supplying pressurized liquid at a predetermined volume for delivery to a load source which may have fixed or varying volume requirements for the fluids pumped. Lower casing 13 has a transverse end face 37 which extends at right angles to the axis 58, FIG. 4.

The pump housing includes upper casing 39, FIGS. 1, 2, 3 and 4. The spherical cavity is further defined by the hemispherical seat 41 within the upper casing which is in opposed registry with the hemispherical seat 19 within the lower casing. Said upper casing has a corresponding end face 43 which is in registry with the end face 37 of the lower casing and is suitably sealed and secured thereto as by a plurality of fasteners 45 and dowels 47. A suitable O-ring seal 67 interposed therebetween.

A compensator body 49 providing for automatic adjustment of the volume delivery for the pump overlies the upper casing 39 and is retained thereon by the fasteners 51. These fasteners as shown in FIG. 2 extend through the compensator body through the upper casing 39 and are threaded down into the lower casing 13 to provide a unit housing.

Rotatively positioned within the spherical seat 19-41 there is provided a spherical gear 53 which in the illustrative embodiment is of hemispherical shape and is entirely nested within the lower casing.

As shown in FIGS. 1, 4 and 5, the spherical gear includes as a part thereof the axial drive shaft 55 which extends through the bore 56 FIG. 4 of the lower casing through corresponding roller bearings 63 and the seal 65 and outwardly of said housing.

A suitable key 57 is applied to outer end of the drive shaft 55 adapted for coupling to the output shaft 61 of the motor 59 schematically shown in FIG. 1. The central longitudinal axis 58 of drive shaft 55 for the spherical gear is sometimes referred to hereafter as a first axis, being the axis of rotation of drive shaft 55 and the spherical gear 53.

The spherical gear, shown in detail in FIGS. 5, 7 and 8, includes a series of wedge shaped radial slots 71. The side walls 72 converge inwardly to provide a series of circularly arranged peripherally spaced radial gear teeth 79 within the spherical gear 53. The inner ends of the converging slots 71 terminate in a hemispherical recess 73 adapted to receive a steel ball 75 shown in dash lines in FIG. 7 and shown in assembly in FIGS. 1 and 4.

The radial slots 71 are further defined by inclined bottom walls 77 which with the converging slide walls 72 of adjacent spherical gear teeth define individual axially extending pumping chambers 99 generally of triangular shape within the spherical gear.

Spherical gear teeth 79 which extend radially inward as shown in FIG. 5 toward the center of the spherical gear 53, are of spherical shape at their outer ends so as to correspond with or form a part of the hemispherical body of the spherical gear for registry with the lower casing hemispherical seat 19. Interposed between the respective radially extending gear teeth 79 of spherical gear and movably positioned within the pumping chambers 99 are a plurality of separate independent radially extending gear teeth 81, FIGS. 4, 5, 8 and 11 through 15.

A separate individual radial gear tooth 81 is individually shown in perspective in FIG. 15, and includes converging side walls 83, FIGS. 12, 14 and 15, the flat bottom wall 85, FIGS. 12 through 15 and the transversely arcuate top wall 87, also shown in FIG. 5. The transversely arcuate top wall 87 as it extends inwardly converges with respect to the flat bottom wall 85 of the separate radial gear with the respective top, bottom and side surfaces of the gear terminating in spherically shaped concave end face 89 adapted for cooperative engaging registry with a portion of the ball 75 shown in FIGS. 4, 11 and 12.

Upon assembly, as shown in FIG. 4, each of the separate teeth 81 have a spherically shaped outer face 91 adapted for cooperative registry with the correspondingly shaped surface of the spherical seat 19 in lower casing.

Formed within the spherical outer face 91 of the individual gear teeth is an elongated arcuate, and spherically shaped recess 93 which as shown in FIG. 4 is in opposed registry with corresponding surfaces of the spherical cavity 19–41 of said housing.

Pressure passage 95 is formed within the radial gear 81 outletting at one end at the spherical recess 93 has a pressure outlet 97 centrally of the bottom wall 85 on said gear.

Pressure outlet 97 for pressure passage 95 communicates with the pumping chamber 99, FIG. 5 and is adapted for successive and progressive communication with the respective inlet 21 and outlet 23 during continued rotation of the spherical gear.

Nested and positioned within the hemispherical cavity 41 within the upper casing 39 of the pump housing is a spherical cam 101 which is substantially hemispherical in shape and portends an arc less than 180° as for example 150° such as shown in FIG. 10 and further shown in FIG. 4.

The spherical cam 101 as shown in perspective in FIG. 5 has a plurality of radially extending continuously formed cam surfaces 103. The corresponding cam surfaces are inclined radially inward towards the central portion of the spherical cam 101. These cam surfaces are normally inclined at an acute angle with respect to the end face defined by the gear teeth 79 of the spherical gear.

The spherical cam 101 though tipped to the extreme pumping position shown in FIG. 4, is shown in FIG. 10 in an upright position and has a central axis 104 which for normal pumping is arranged at a variable acute angle with respect to a spherical gear axis 58 shown in FIG. 4.

The central axis 104 of the spherical cam sometimes referred to as a second axis, is inclined at an acute angle with respect to axis 58. This inclination may range between zero and 20 degrees approximately. It is the extent of the acute angle between first axis 58 and second axis 104 which determines the volume of liquid delivery through the outlet passage 31 and the outlet pipe 33 to a liquid load. The present pump includes an automatic mechanism by which the angularity between these respective axes 58, 104 may be automatically adjusted, should there be some falling off of the load demand requiring a reduction in the volume of liquids pumped. Accordingly, there is provided a means within the housing connected with the hemispherical cam 101 for angularly adjusting the cam in a single phase. This reduces the acute angle between the axes 58 and 104 and accordingly reduces the pumping volume of liquids through outlet passage 31.

Cam face 103 includes a plurality of cam surfaces which extend generally radially inward and terminate in the hemispherical recess 105 which is adapted to receive the ball 75 interposed between cam 101 and spherical gear 53. In order to restrain the hemispherical cam to rotation within a single plane there are provided a pair of guide dowels 109, FIG. 4, which are nested and retained within corresponding converging angularly related slots 111 within the upper casing. The ends of the dowels extend in the arcuate slot 107 formed within said spherical cam which portends an arc of 115 degrees, approximately.

Elongated control dowel 113 extends into and is secured within the radial bore 115 within cam 101 extends along the second axis 104, being the central axis of said cam, and extends outwardly of the upper casing 39 and into the control chamber 117 of the compensator body 49, shown in FIGS. 1, 2, 3 and 4. The compensator body has a cylinder which includes the bore 123 and movably positioned therein control piston 119 whose spherical end 121 is in engagement with one side of the control dowel 113.

Passage 125 at one end communicates with the bore 123 of said cylinder and at its other end connects communicating pressure passages 127 and 129 in communication into outlet passage 31. The passage 127 is formed within the upper casing 39 and the pressure passage 129 is formed within the lower casing 13. O-ring 131 is interposed between said casings for sealing off the pressure passage 125, 127 and 129.

Spring biasing means are applied to the opposite side of control dowel 113. In the illustrative embodiment, this biasing means includes ball 133 within control chamber 117 of the compensator body 49 and compression spring 135 is nested within bore 137 in body 49 and at one end engages the ball 133.

The opposite end of the spring is engaged by the circular slide 139 movably positioned within bore 137 and sealed therein as by O-ring 141. Spring adjustment retainer screw 143 is threaded into the counter bore 145 and at its inner end is in operative engagement with slide 139. By adjustment of the screw 143 the compression within spring 135 can be modified for determining the amount of pressure which must be applied through the passages 125, 127 and 129 in order to effect rotary adjustment of control cam 101.

OPERATION

A power rotated spherical gear 53 whose drive shaft 55 is journaled within the housing along the first axis 58, FIG. 4 is of hemispherical form and is entirely nested within hemispherical cavity 19 of lower casing 13. The corresponding radially extending gear teeth 79 forming a part of the spherical gear 53 are continuations of the spherical surface of the spherical gear 53 for cooperative registry with spherical cavity 19.

The opposed side walls 71 of the gear teeth 79 converging towards the center of the spherical gear define a series of peripherally spaced pumping chambers 99. Between said teeth there are pivotally or rockably mounted a plurality of separate radial gear teeth 81 which are of converging shape in plan such as shown in FIG. 12, for cooperative nesting within the pumping chambers between the gear teeth 79 as assembled within the spherical seat 19-41. The inner concave spherical ends 89 of teeth 81 are at all times in engagement with the steel ball 75, which is centrally interposed between the spherical gear and the spherical cam upon the first axis 58 and at the point where the first axis intersects the second or central axis 104 for the cam 101.

With the drive shaft 55 on axis 58 power rotated as by the motor 59 schematically shown in FIG. 1 through a suitable coupling and the key 57 and a corresponding rotation of the spherical gear 53 within the spherical seat, the centrifugal forces developed upon the separate radially extending gear teeth 81 cause these gear teeth to be biased axially outward for operative engagement at all times with respect to the cam surfaces 103 of cam 101. Said cam surfaces are essentially stationary with respect to the rotating spherical gear.

Accordingly during power rotation of the spherical gear, the individual separate radial gear teeth 81 or segments are movably and in effect pivotally mounted within the respective pumping chambers 99 defined between the spherical gear teeth 79. These separate gear teeth are each pivotal with respect to the central ball 75 and movable within planes which pass through the first axis 58. This creates a pumping action within the respective chambers 99 of varying dimension depending upon the direction movement of the respective gears 81. Thus upon one side of the pump adjacent the spherical cavity 19, liquid from the delivery pipe 27 moves through the inlet passage 25 through the inlet 21, FIG. 6 and pressurized liquid is delivered through the corresponding outlet 23 through the outlet passage 31 and through the load pipe 33 for satisfying the predetermined load volume of liquid delivered by pump 11. Since the pumping action achieved is directly dependent upon the angular relationship between axis 58 and the central axis 104 of cam 101, as shown in FIG. 4, there is a maximum pumping action with the acute angle between said axes at a maximum of approximately 20 degrees, for illustration. The compression of spring 135 within the compensator body 49 acts upon the ball 133 and biases the dowel 113 to the extreme angular position shown against the piston 119 within the cylinder 123.

When the pump is delivering a maximum volume through the passage 31, the pressure in a communicating pressure passages 129, 127 and 125 is insufficient to move the piston 119 against the spring 135 and ball 133. Should there be some fall off in the demand for a predetermined volume of liquid through the outlet 31 and pipe 33, pressure in the outlet passage 31 will be transmitted through the passages 129, 127 and 125 and into the cylinder chamber 123 to act upon the piston 119. This causes the piston 119 to move to the right a limited distance against the action of the ball and spring 135 whereby reducing the angle between axes 58 and 104. This provides for reduction of the pumping volume of fluids or liquids leaving the passage 31.

The pumped volume decreases proportionally to the pivotal movement of the dowel pin 113, which is constrained for rotary movement in a single plane due to the functioning of the corresponding guide dowels 109, FIG. 4.

If there is a complete cut-off of the demand for pressure fluid or liquid through the pipe 33, the available pumped fluid is communicated through the passages 129, 127 and 125 in the cylinder 123 causing a maximum movement of the piston 119 to the right of what is shown in FIG. 4. This causes a corresponding maximum movement of the dowel 113 to the right so that the cam axis 104 is coincident with the first axis 58 of the drive shaft for the spherical gear 53. At this pont there is no pumping action. Here the respective radial pumping gears 81 have no further reciprocal movement or at least such such limited movement that whatever pumping action is developed, any fluid pressure developed at the outlet passage 31 is communicated to the cylinder 123 within the compensator body 49. At the same time the pumping volume through the outlet passage 31 is zero.

On the other hand, should there now be an increased demand for pressurized liquid, the pressure of the fluid communicated through the passages 129, 127 and 125 will be proportionately reduced permitting the spring 135 and ball 133 to move to the left including the corresponding movement of piston 119 until the pressure within the chamber 123 is equal to the spring pressure developed. Now there is defined an acute angular relationship between the axes 104 and 58 with some pumping action established so that liquids under pressure are now delivered through outlet passage 31. With a maximum demand of volume through the outlet passage 31, the pressure within the corresponding pressure passages 129, 127 and 125 is reduced to the point that the spring 135 is effective to move the piston 119 to the extreme position shown in FIG. 4. Thus, the maximum acute angle has been established between the first and second axes 58 and 104 for the maximum pumping volume though the outlet passage 31 and pipe 33.

The housing parts including the spherical gear are heat treated and the cavity is ground to a hardness in the range approximately 58–60 Rockwell "c" scale provides for a good and efficient bearing relationship between the moving parts of the present pump. In accordance with the disclosure, the present pump has a variable capacity of between 0 and 1000 gallons per minute, for illustration. The pressures can range up to 10,000 pounds per square inch, approximately, depending upon the construction contemplated.

The primary importance and believed originality in the present disclosure is that the separate and independent radial gears 81 move within planes which pass through the first axis 58. Thus, any stresses upon the respective individual gears are transmitted throughout the entire housing of the pump.

The pressurized liquids which are communicated through the individual gears 81 and through the passages 95 and 97 apply additional forces between the spherical cavity 19, 41 and the outer ends of the respective separate gears 81 for reducing frictional contact therewith and for further biasing the individual teeth radially inward into contact with the ball 75.

It is contemplated that the cam axis 104 could continue to move past alignment with axis 58. In that case, the direction of pumping liquids is reversed with the movement of fluid from 31 to 25 as shown in FIG. 4.

With reference to FIGS. 1, 2 and 4, for clarity of illustration, the lower casing 13 has been rotated 90° from where it would normally be located.

Referring to FIGS. 7 and 8, the walls 72 which define the spherical gear teeth 79 appear flat. In a preferred embodiment, in actual use these surfaces are arcuate defining conical segments. The corresponding opposing sides 83 of the separate gear teeth 81, FIG. 15 are similarly formed. This is shown in further detail in FIG. 16 wherein the conical surfaces 147, 149 of the separate gear teeth 81 are adapted to cooperatively register with the corresponding complemental conical surfaces formed in the walls 72 of gear teeth 79.

The present gear pump can also function as a motor by reversing the operation. By delivering pressurized liquid to either of the inlet or outlet 25, 31 the operation of the gear pump is reversed to function as a motor for driving shaft 55.

In accordance with the description of the operation of the variable volume gear pump, the operation is the same except that the spherical gear is rotated with its shaft 55 for providing a torque thereto. It is therefore considered as equivalent that in the present variable gear pump, the reverse operation is in effect a gear motor or a fluid motor.

Having described my invention, reference should now be had to the following claims.

I claim:

1. A pump comprising:

a housing;

a gear rotatably, mounted about an axis in said housing, said gear having a plurality of peripherally spaced apart gear teeth defining a plurality of chambers between adjacent spaced apart gear teeth, said gear teeth each having a radial top surface defining a radial end face of said gear;

a plurality of separate gear teeth wherein each separate gear tooth is nested within one of said chambers and each separate gear tooth has a radial top wall;

cam means facing said end face of said gear and in continuous engagement with all said radial top walls of said separate gear teeth upon rotation of said gear for causing progressive inward and outward reciprocating movement of said separate gear teeth within said chambers upon rotation of said gear;

fluid inlet means for providing fluid communication adjacent the outward movement of said separate gear teeth;

fluid outlet means for providing fluid communication adjacent the inward movement of said separate gear teeth.

2. A pump as recited in claim 1 further including:

means for adjusting said cam means thereby varying the magnitude of said reciprocating movement of said separate teeth.

3. A pump as recited in claim 1 wherein said separate gear teeth reciprocate in a plane defined by the axis of rotation of said gear.

4. A pump as recited in claim 2 further including means for automatically actuating said cam adjusting means responsive to fluid pressure in said fluid outlet means.

5. A pump as recited in claim 2 wherein said separate gear teeth reciprocate in a plane defined by the axis of rotation of said gear.

6. A spherical gear pump comprising an apertured housing having a first longitudinal axis, a spherical seat, an inlet and outlet in said housing adjacent said seat and inlet and outlet passages respectively communicating with said inlet and outlet, adapted respectively for connection to a source of liquid and a liquid load;

a hemispherical gear rotatively nested within said seat including a plurality of peripherally spaced radial gear teeth and an axial drive shaft projected through and journaled upon said housing along said axis;

said gear teeth defining an end face of said hemispherical gear at right angles to said axis;

a substantially hemispherical cam portending an arc less than 180° adjustably positioned within said seat having radial cam surfaces facing said end face and a second longitudinal axis at an acute angle to said first axis;

said hemispherical gear teeth defining a plurality of radially extending pumping chambers adjacent to and progressively connected with said inlet and outlet, each chamber having a bottom wall;

and a plurality of separate symmetrical radial gear teeth positioned within and rotatable with said hemispherical gear alternated with said hemispherical gear teeth, each of said separate teeth having a radial top wall normally biased against and with said radial top wall continuously contacting said cam surfaces on rotation of said hemispherical gear and a bottom wall reciprocally moved up and down within a pumping chamber relative to its bottom wall on rotation of said separate radial gear teeth over said cam surfaces wherein said downward movement is caused only by said radial top walls of said separate teeth contacting said cam surfaces.

7. In the spherical gear pump of claim 1, said separate radial gear teeth extending axially of said spherical gear and positioned within said pumping chambers respectively for pivotal movements in planes passing through said first axis.

8. In the gear pump of claim 1, said drive shaft adapted for connection to a rotative power source.

9. In the pump of claim 6, said housing including an apertured lower casing having a hemispherical first seat, said hemispherical gear being enclosed and rotatable within said lower casing;

and an upper casing having a hemispherical second seat;

said substantially hemispherical cam being nested and adjustably retained within said upper casing.

10. In the pump of claim 6, said cam surfaces being inclined at an acute angle to said hemispherical gear end face.

11. In the pump of claim 10, means for varying said acute angle wherein reduction of said acute angle correspondingly decreases the volume of liquids delivered through said outlet passage.

12. In the pump of claim 11, wherein when said means for varying reduced said acute angle to zero, said first and second axes are coincident and the pumping volume is zero.

13. In the pump of claim 1, means for adjusting said acute angle between said first and second axes wherein the maximum angle provides maximum volume liquid delivery, reduction of said angle correspondingly reduces said volume and reduction of said angle to zero cuts off all pumping volume.

14. A spherical gear pump comprising an apertured housing having a first longitudinal axis, a spherical seat, an inlet and outlet in said housing adjacent said seat, inlet and outlet passages respectively communicating with said inlet and outlet, adapted respectively for connection to a source of liquid and a liquid load;

a hemispherical gear rotatively nested within said seat including a plurality of peripherally spaced radial gear teeth with each gear tooth having a radially extending top face with said top faces defining a radial end face of said gear and said gear having an axial drive shaft projected through and journaled upon said housing along said axis;

a substantially hemispherical cam portending an arc less than 180° adjustably positioned within said seat having radial cam surfaces facing the end face of said gear and said cam having a second longitudinal axis at an acute angle to said first axis;

said hemispherical gear teeth defining a plurality of radially extending axial pumping chambers adjacent to and progressively connected with said inlet and outlet successively;

and a plurality of separate symmetrical radial gear teeth positioned within and rotatable with said hemispherical gear alternated with said hemispherical gear teeth, each of said separate teeth having a radial top wall being normally biased against and with said radial top wall continuously contacting said cam surfaces on rotation of said hemispherical gear and reciprocally moved up and down within a pumping chamber on rotation of said separate radial gear teeth over said cam surfaces wherein said downward movement is caused only by said radial top walls of said separate teeth contacting said cam surfaces.

15. In the gear pump of claim 6, the biasing of said separate gear teeth against said cam surfaces including centrifugal forces created upon rotation of said hemispherical gear.

16. In the spherical pump of claim 6, means on said housing guidably engaging said cam limiting its adjustments to a single plane passing through said first axis.

17. In the gear pump of claim 16, moveable means connected to said cam for adjusting the angle between said first and second axes.

18. In the gear pump of claim 17, the maximum angle between said axes providing maximum volume liquid delivery, reduction of said angle proportionally reducing said pumping volume, and reducing said angle to zero cutting off all pumping volume.

19. In the spherical gear pump of claim 12, said guide means including a pair of spaced coplanar converging dowels mounted upon said housing and extending into a coplanar arcuate slot with said substantially hemispherical cam.

20. In the spherical gear pump of claim 17, said movable means connected to said cam including a dowel pin at one end secured to said cam and projecting radially outward of said seat and housing;

a compensator body mounted upon said housing having a control chamber receiving the other end of said dowel pin;

a cylinder within said compensator body including a piston at one end bearing against said dowel pin;

spring means within said compensator body bearing against the other side of said dowel pin normally biasing said dowel pin and connected cam to an extreme position corresponding to the maximum angle between said first and second axes;

there being a passage within said housing and compensator body interconnecting said outlet passage and said cylinder, said piston being responsive to and movable by pressure liquid from said outlet passage for moving said dowel pin against its spring bias depending upon the demands of said liquid load.

21. In the gear pump of claim 20, said spring means including a ball in said control chamber engaging said dowel pin, and a coiled spring retained in said body coaxial of said piston and ball and yieldably bearing against said ball.

22. In the gear pump of claim 21, said compensating body having a bore coaxial of said piston, ball and spring;

an adjustable slide stop sealed within said bore bearing against said spring;

and an adjusting screw in said bore bearing against said slide stop for regulating the compression of said spring.

23. In the spherical pump of claim 6, there being opposed axial hemispherical recesses in said hemispherical gear and cam centrally thereof;

and a ball within said receses engaging said hemispherical gear and cam, the inner ends of said separate gear teeth at all times being in operative engagement with said ball.

24. In the spherical gear pump of claim 23, the inner ends of said separate gear teeth having spherical recesses therein receiving portions of said ball.

25. In the spherical gear pump of claim 6, the outer ends of said separate gear teeth extending to the periphery of said hemispherical gear teeth, and being spherically shaped corresponding to the curvature of said hemispherical gear and in cooperative registry with said spherical seat.

26. In the spherical gear pump of claim 20, said compensator body being reversible end to end upon said housing for adapting to a reversal of the direction of rotation of said hemispherical gear;

there being an additional pressure passage in said housing diametrically opposed to said first pressure passage establishing communication between said inlet passage and said cylinder, the functions of said inlet and outlet passages being reversed.

27. In the gear pump of claim 25, the spherical surface of the outer end of each separate gear tooth having an arcuate recess therein opposed to said seat;

there being a fluid pressure passage in each separate gear tooth communicating with said arcuate recess and with the bottom of each separate gear tooth establishing fluid communication between each pumping chamber and said seat for biasing said separate gear teeth radially inward of said seat.

28. In the gear pump of claim 24, the outer ends of said separate gear teeth extending to the periphery of said hemispherical gear teeth, and being spherically shaped corresponding to the curvature of said hemispherical gear and in cooperative registry with said spherical seat;

the spherical surfaces of the outer ends of said separate gear teeth having an arcuate recess therein opposed to said seat;

there being a fluid pressure passage in each separate gear tooth communicating with said arcuate recess and with the bottom of each separate gear tooth establishing fluid communication between each pumping chamber and said seat biasing said separate gear teeth radially inward of said seat and into operative engagement with said ball between said hemispherical gear and substantially hemispherical cam;

said separate gear teeth adapted for pivotal movements in radial planes passing through said first axis.

29. In the gear pump of claim 6, the sides of said hemispherical gear teeth and the corresponding sides of said separate gear teeth converging inwardly.

30. In the gear pump of claim 6, the top and bottom walls of said separate gear teeth converging inwardly, the corresponding bottom wall of said pumping chamber being inclined at an acute angle to said first axis.

31. In the gear pump of claim 29, the top and bottom walls of said separate gear teeth converting inwardly, the corresponding bottom wall of said pumping chamber being inclined at an acute angle to said first axis.

32. In the gear pump of claim 6, the radial top wall of said separate gear teeth being transversely arcuate for a line contact with said cam surfaces.

33. In the spherical gear pump of claim 6, the housing, seat and hemispherical gear being heat treated for increased hardness providing a bearing surfaces for said hemispherical gear and separate gear teeth.

34. The method of pumping liquids comprising, rotating a hemispherical gear having an equatorial base within a spherical seat within a pump housing upon a first axis;

positioning a substantially hemispherical cam portending an arc of less than 180° within said seat, said cam having a second axis inclined at an acute angle to said first axis and radial cam surfaces wherein said cam surfaces face said equatorial base;

mounting a plurality of separate peripherally spaced radial gear teeth each having a radial top wall upon said hemispherical gear, centrifugally biasing said radial top walls of all of said separate gear teeth into continuous operative engagement with said cam surfaces on rotation of the hemispherical gear;

and thereby reciprocally pivoting said separate gear teeth for rocking reciprocal motion in radial planes passing through said first axis.

35. In the method of claim 34, automatically reducing the acute angle between said axes in response to volume demands at the pump outlet passage and reducing the pumping volume corresponding to the load demand connected to said pump.

36. In the gear pump of claim 29, the sides of the hemispherical gear teeth and the corresponding sides of the separate gear teeth being correspondingly shaped to define complimental conical surface segments.

37. A pump comprising:

a housing having a seat wherein the seating surface is defined by a sphere;

a gear having a portion of its exterior surface defined by a sphere rotatably nested about an axis in said seat with said exterior portion in engaging registry with said seating surface;

said gear including a plurality of circumferentially spaced apart radial gear teeth having an outer surface forming at least a portion of said gear exterior surface defined by said sphere and said gear teeth each having a radial top surface defining a radial end face of said gear;

said gear teeth defining a plurality of radially extending chambers between adjacent spaced apart gear teeth;

a plurality of separate gear teeth wherein each separate gear tooth is nested within one of said radial chambers;

each separate gear tooth having an outer surface with at least a portion of said outer surface being in engaging registry with said seating surface and each separate gear tooth having a radial top wall;

cam means facing said end face of said gear in continuous engagement with all said radial top walls of said separate gear teeth upon rotation of said gear for causing progressive inward and outward reciprocating movement of said separate gear teeth within said chambers upon rotation of said gear by said rotation biasing said radial top walls of said separate gear teeth in operative engagement with said cam means;

fluid inlet means for providing fluid communication adjacent the outward movement of said separate gear teeth;

fluid outlet means for providing fluid communication adjacent the inward movement of said separate gear teeth.

38. A pump as recited in claim 37 further including:

means for adjusting said cam means thereby varying the magnitude of said reciprocating movement of said separate teeth.

39. A pump as recited in claim 37 wherein said separate gear teeth reciprocate in a plane defined by the axis of rotation of said gear.

40. A pump as recited in claim 38 further including means for automatically actuating said cam adjusting means responsive to fluid pressure in said fluid outlet means.

41. A pump as recited in claim 38 wherein said separate gear teeth reciprocate in a plane defined by the axis of rotation of said gear.

42. A pump or motor comprising:

a housing including a seat;

a hemispherical gear nested in said seat for rotation about the axis of said hemispherical gear;

said hemispherical gear including a plurality of peripherally spaced apart radial gear teeth each having a radial top surface defining an equatorial end face of said gear, and with each of said radial gear teeth having a first and a second radial side wall wherein the first radial side wall and the second radial side wall of adjacent spaced apart radial gear teeth define a chamber therebetween; wherein, said first and said second radial side walls of adjacent teeth converge in the direction from the periphery toward the axis of said hemisphere thereby providing generally triangularly shaped chambers between adjacent radial gear teeth;

said first radial side walls have an arcuate conical surface bulging outward along the length of said radial side wall in a direction perpendicular to the radial;

said second radial side walls have a complementary arcuate conical surface bulging inward along the length of said radial side wall in a direction perpendicular to the radial;

a plurality of separate gear teeth wherein one separate gear tooth is movably nested in each chamber;

each separate gear tooth has a first side wall and a second side wall in engaging registry respectively with the radial gear tooth first radial side wall and the radial gear tooth second radial side wall defining the chamber;

whereby the first side wall of said separate gear tooth bulges inward complementary to the outward bulge of the first radial side wall of the radial gear tooth defining said chamber and the second side wall of said separate gear tooth bulges outward complementary to the inward bulge of the second radial side wall of the radial gear tooth defining said chamber.

43. A pump or motor as recited in claim 42 further including:

cam means in continuous engagement with said separate gear teeth for causing progressive inward and outward reciprocating movement of said separate gear teeth within said chambers upon rotation of said gear;

fluid inlet means for providing fluid communication adjacent the outward movement of said separate gear teeth;

fluid outlet means for providing fluid communication adjacent the inward movement of said separate gear teeth.

44. A pump or motor as recited in claim 43 further including:

means for adjusting said cam means thereby varying the magnitude of said reciprocating movement of said separate gear teeth.

45. A pump or motor as recited in claim 44 wherein said separate gear teeth reciprocate in a plane defined by the axis of rotation of said gear.

46. A motor comprising:

a housing;

a gear member rotatably mounted about an axis in said housing, said gear having a plurality of peripherally spaced apart gear teeth defining a plurality of chambers between adjacent spaced apart gear teeth, said gear teeth each having a radial top surface defining a radial end face of said gear;

a plurality of separate gear teeth wherein each separate gear tooth is nested within one of said chambers and each separate gear tooth has a radial top wall;

cam means facing said end face of said gear and in continuous engagement with all said radial top walls of said separate gear teeth upon rotation of said gear for causing progressive inward and outward reciprocating movement of said separate gear teeth within said chambers upon rotation of said gear;

fluid inlet means for providing fluid communication adjacent the outward movement of said separate gear teeth;

fluid outlet means for providing fluid communication adjacent the inward movement of said separate gear teeth.

47. A motor as recited in claim 46 further including:

means for adjusting said cam means thereby varying the magnitude of said reciprocating movement of said separate teeth.

48. A motor as recited in claim 46 wherein said separate gear teeth reciprocate in a plane defined by the axis of rotation of said gear.

49. A motor as recited in claim 47 wherein said separate gear teeth reciprocate in a plane defined by the axis of rotation of said gear.

50. A motor comprising:

a housing having a seat wherein the seating surface is defined by a sphere;

a gear having a portion of its exterior surface defined by a sphere rotatably nested about an axis in said seat with said exterior portion in engaging registry with said seating surface;

said gear including a plurality of circumferentially spaced apart radial gear teeth having an outer surface forming at least a portion of said gear exterior surface defined by said sphere and said gear teeth each having a radial top surface defining a radial end face of said gear;

said gear teeth defining a plurality of radially extending chambers between adjacent spaced apart gear teeth;

a plurality of separate gear teeth wherein each separate gear tooth is nested within one of said radial chambers;

each separate gear tooth having an outer surface with at least a portion of said outer surface being in engaging registry with said seating surface and each separate gear tooth having a radial top wall;

cam means facing said end face of said gear in continuous engagement with all said radial top walls of said separate gear teeth upon rotation of said gear for causing progressive inward and outward reciprocating movement of said separate gear teeth within said chambers upon rotation of said gear by said rotation biasing said radial top walls of said separate gear teeth in operative engagement with said cam means;

fluid inlet means for providing fluid communication adjacent the outward movement of said separate gear teeth;

fluid outlet means for providing fluid communication adjacent the inward movement of said separate gear teeth.

51. A motor as recited in claim 50 further including:

means for adjusting said cam means thereby varying the magnitude of said reciprocating movement of said separate teeth.

52. A motor as recited in claim 50 wherein said separate gear teeth reciprocate in a plane defined by the axis of rotation of said gear.

53. A motor as recited in claim 51 wherein said separate gear teeth reciprocate in a plane defined by the axis of rotation of said gear.

* * * * *